US005330121A

United States Patent [19]

Eley

[11] Patent Number: 5,330,121

[45] Date of Patent: * Jul. 19, 1994

[54] SUPPORT BRACKET FOR HOSE REELS

[76] Inventor: John H. Eley, Box 8, Orchard, Nebr. 68764

[ * ] Notice: The portion of the term of this patent subsequent to May 5, 2009 has been disclaimed.

[21] Appl. No.: 46,589

[22] Filed: Apr. 12, 1993

[51] Int. Cl.[5] ..... B65H 75/40

[52] U.S. Cl. ..... 242/401; 242/399.2; 242/403.1

[58] Field of Search ..... 242/86, 86.1, 86.2, 242/86.3, 86.64, 86.7, 86.8, 86.5 R, 86.5 A, 96, 100, 99, 106; 137/355.2, 355.21, 355.26, 355.27

[56] References Cited

U.S. PATENT DOCUMENTS

| | | | |
|---|---|---|---|
| 268,510 | 12/1882 | Martin | 242/86.2 X |
| 672,543 | 4/1901 | Wirt | 242/86 |
| 2,219,201 | 10/1940 | Smith | 137/355.23 |
| 2,823,074 | 2/1958 | Bernard, Jr. | 299/78 |
| 2,964,258 | 12/1960 | Kutil | 242/86 X |
| 4,137,939 | 2/1979 | Chow | 242/86.2 X |
| 4,304,372 | 12/1981 | Smith et al. | 242/106 X |
| 4,655,399 | 4/1987 | Harvey | 239/745 |
| 4,700,737 | 10/1987 | Nelson | 137/355.27 |
| 5,056,732 | 10/1991 | Nicholson, Jr. | 242/106 |
| 5,109,882 | 5/1992 | Eley | 137/355.21 |
| 5,179,972 | 1/1993 | Eley | 242/86.2 X |

FOREIGN PATENT DOCUMENTS

| | | | |
|---|---|---|---|
| 249271 | 12/1962 | Australia | 242/86.2 |
| 1248439 | 11/1960 | France | 242/86 |
| 384787 | 12/1932 | United Kingdom | 299/78 |

*Primary Examiner*—John M. Jillions

*Attorney, Agent, or Firm*—Zarley, McKee, Thomte, Voorhees & Sease

[57] ABSTRACT

A support bracket is designed to support a reel member rotatably mounted on a horizontal portion of an upstanding tube, the reel member having a pair of annular flanges projecting outwardly from a hub to form an annular channel for receiving a hose thereon. The lower end of the upstanding tube is rotatably mounted to one end of a support arm so that the entire reel and upstanding tube member will rotate around a vertical axis. The support arm has a short depending arm which is slidably mounted within a tubular support.

8 Claims, 4 Drawing Sheets

SUPPORT BRACKET FOR HOSE REELS

TECHNICAL FIELD

The present invention relates generally to reels for hoses, and more particularly to a support bracket for hose reels which permits simple removal and attachment of a hose reel to a support.

BACKGROUND OF THE INVENTION

Various types of hose reels have been known for a long period of time. In the field of high pressure washers, a hose reel is utilized to permit the extension and retraction of a spray nozzle from the washer unit.

One problem with prior art hose reels for pressure washers was in their limitation on the direction in which the hose could be retracted. Typically, the hose could only be retracted forwardly from the reel, thereby requiring the user to move the entire washer in order to retract the hose from a rearward direction. Furthermore, while hose guides have been utilized in various types of reels, they were typically fixed, thereby limiting the direction in which the hose could be extended or retracted on the hose reel.

Yet another problem with prior hose reels is in their method of mounting on or adjacent to the high pressure washer. In most cases, the reel is permanently mounted to the washer, or affixed in a fashion which prevented quick and easy removal. Thus, it was necessary to utilize separate and additional hose reels for each various task.

SUMMARY OF THE INVENTION

It is therefore a general object of the present invention to provide an improved support bracket for a reel.

Yet another object is to provide a support bracket for a hose reel which permits quick and easy mounting and dismounting of a hose reel.

These and other objects will be apparent to those skilled in the art.

The support brackets of the present invention are designed to support a reel member rotatably mounted on a horizontal portion of an upstanding tube, the reel member having a pair of annular flanges projecting outwardly from a hub to form an annular channel for receiving a hose thereon. The lower end of the upstanding tube is rotatably mounted to one end of a support arm so that the entire reel and upstanding tube member will rotate around a vertical axis. The support arm has a short depending arm which is slidably mounted within a tubular support.

DESCRIPTION OF THE PREFERRED EMBODIMENTS

Figure 1:
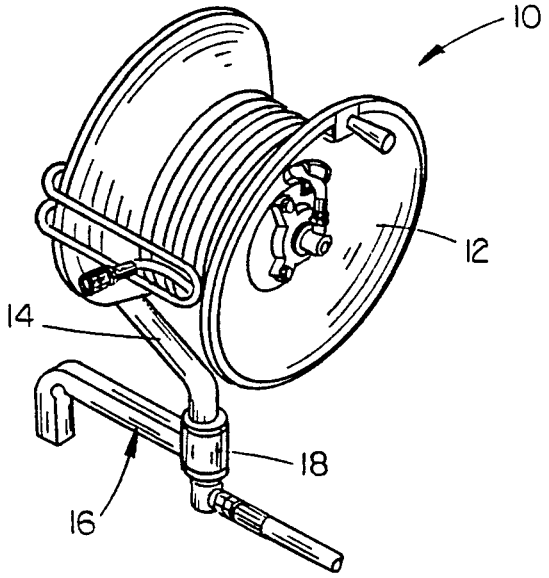
FIG. 1 is a perspective view of the present invention.

Referring now to the drawings, in which similar or corresponding parts are identified with the same reference numeral, and more particularly to FIG. 1, the hose reel which is utilized with the present invention is designated generally at 10 and includes a reel 12 rotatably mounted on an upstanding tube 14 which is pivotally connected to a support arm 16 such that the reel 12 will pivot on a vertical axis extending to the connection of upstanding tube 14 with support arm 16 while permitting rotation of reel 12 on a horizontal axis on the upper end of upstanding tube 14.

Figure 2:
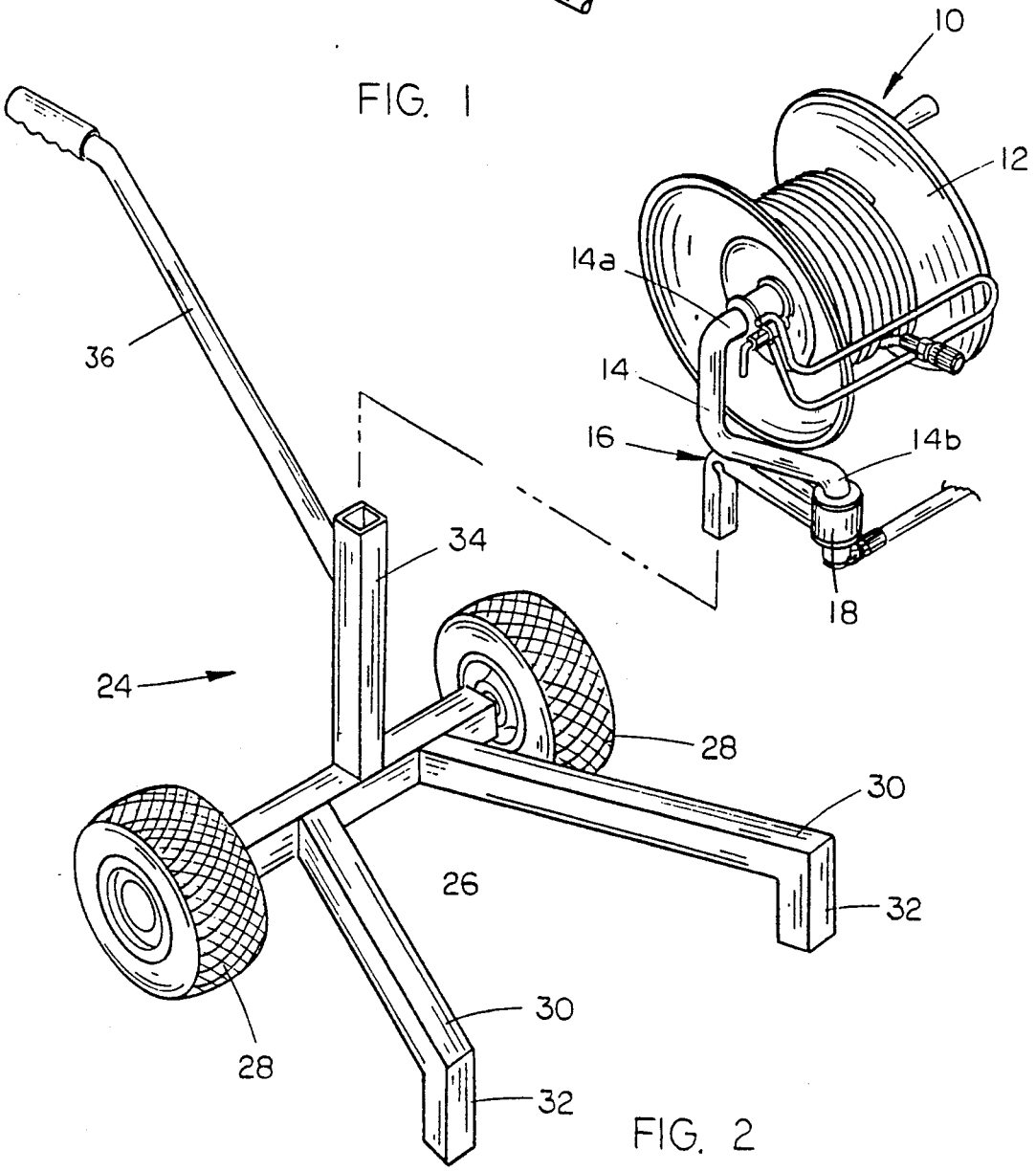
FIG. 2 is a perspective view of the invention with the hose reel removed from the support bracket.

Referring now to FIG. 2, upstanding tube 14 includes an horizontal upper end **14*a* upon which reel 12 is rotatably mounted. The lower end 14*b* of the tube 14 is rotatably mounted on a vertical axis within a sleeve 18, to permit 360° rotation of tube 14**.

Support arm 16 is preferably formed from a hollow tubular member bent into a generally L-shaped member having a horizontal leg 20 and a short vertical leg 22, with sleeve 18 mounted on the end of horizontal leg 20.

Hose reel 10 can be utilized in many ways, and is therefore adapted for easy removal and transportability. As shown in FIG. 2, a two wheel cart 24 is designed for supporting and transporting hose reel 10. Cart 24 includes an axle 26 having a pair of wheels 28 rotatably mounted thereon. A pair of support legs 30 extend forwardly from axle 26 and have depending feet 32 thereon for ground support. A vertical square receiver tube 34 projects upwardly from axle 26. The upper end of receiver tube 34 is sized to receive leg 22 of support arm 16 snugly therein, yet permit easy, slidable removal of hose reel 10. A handle 36 projects rearwardly and upwardly from receiver tube 34 to permit ease of movement of the hose reel on cart 24.

Figure 3:
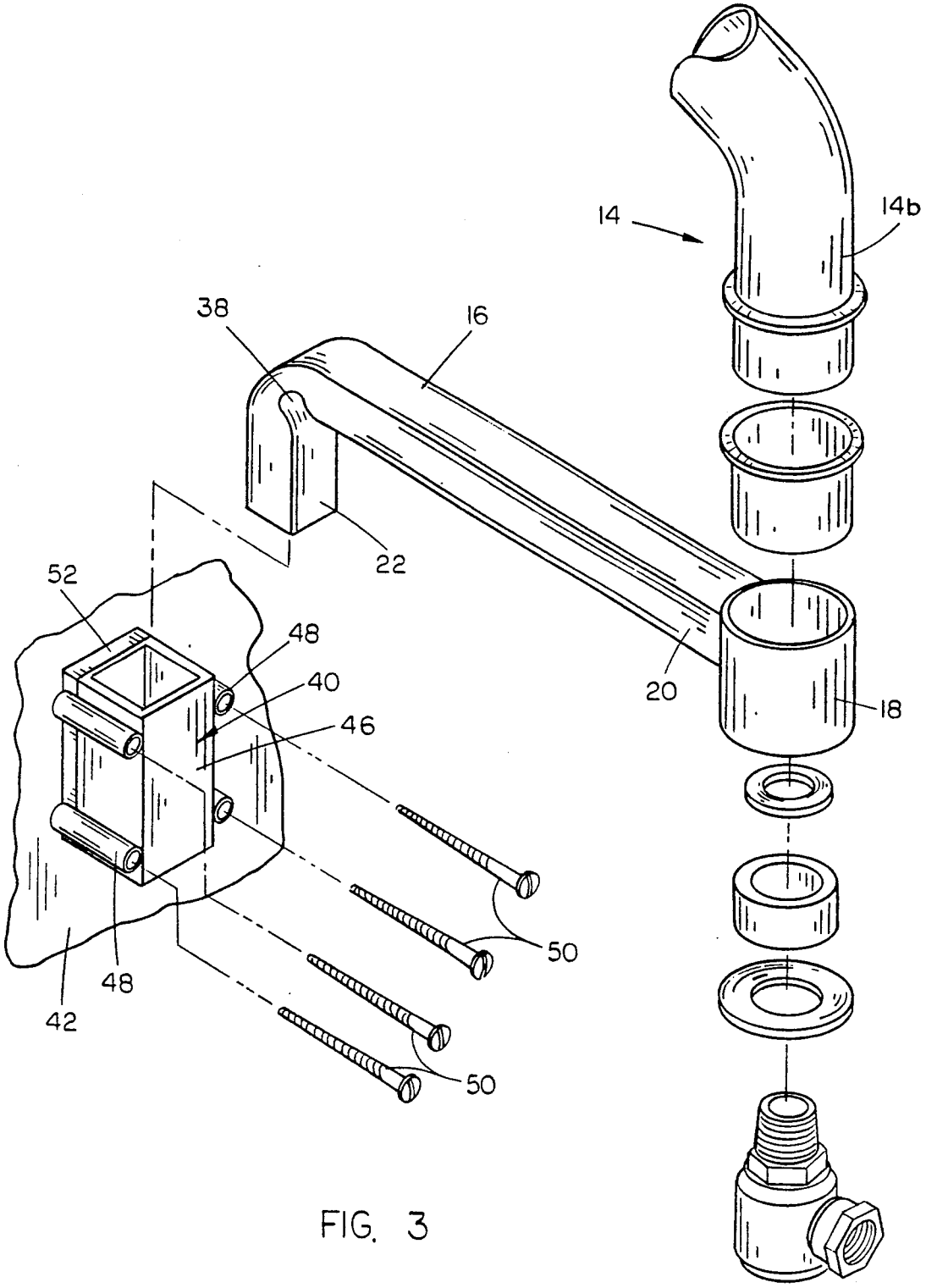
FIG. 3 is an exploded perspective view of the connection between the second embodiment of a support arm and a support bracket.
Figure 6:
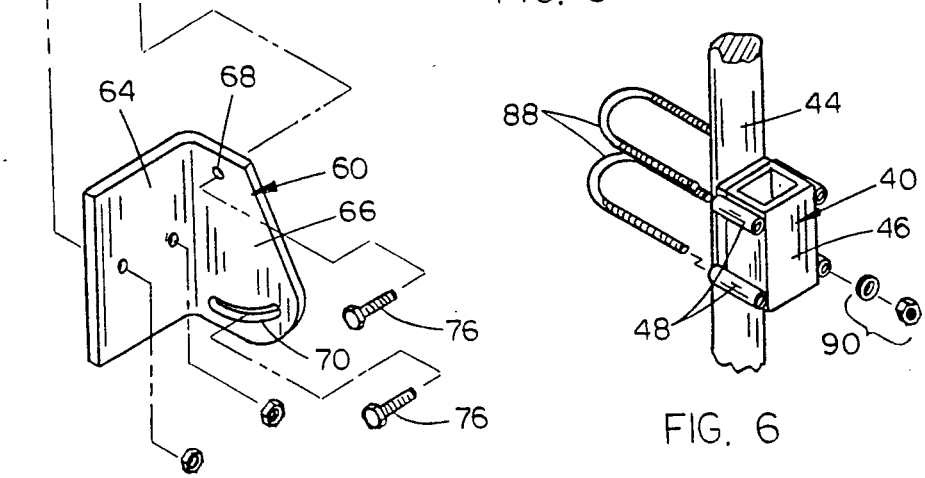
FIG. 6 is a perspective view of the support bracket shown in FIG. 3, as utilized on a vertical pole.

Referring now to FIG. 3, vertical leg 22 is formed in support arm 16 with crush-bend, designated at 38 in the drawings. A special bracket 40 may be mounted to a wall 42 or on a vertical pole 44 (as shown in FIG. 6). Bracket 40 includes a square, vertically oriented receiver tube 46 with four transverse sleeves 48 mounted thereon. Woodscrews 50 or the like are inserted through sleeves 48 to fasten tube 46 to wall 42. A support plate 52 is mounted to one side of tube 46 to increase strength and prevent crushing of the tube. Thus, hose reel 10 may be mounted on a wall or the like utilizing bracket 40 in combination with support arm 16.

Figure 4:
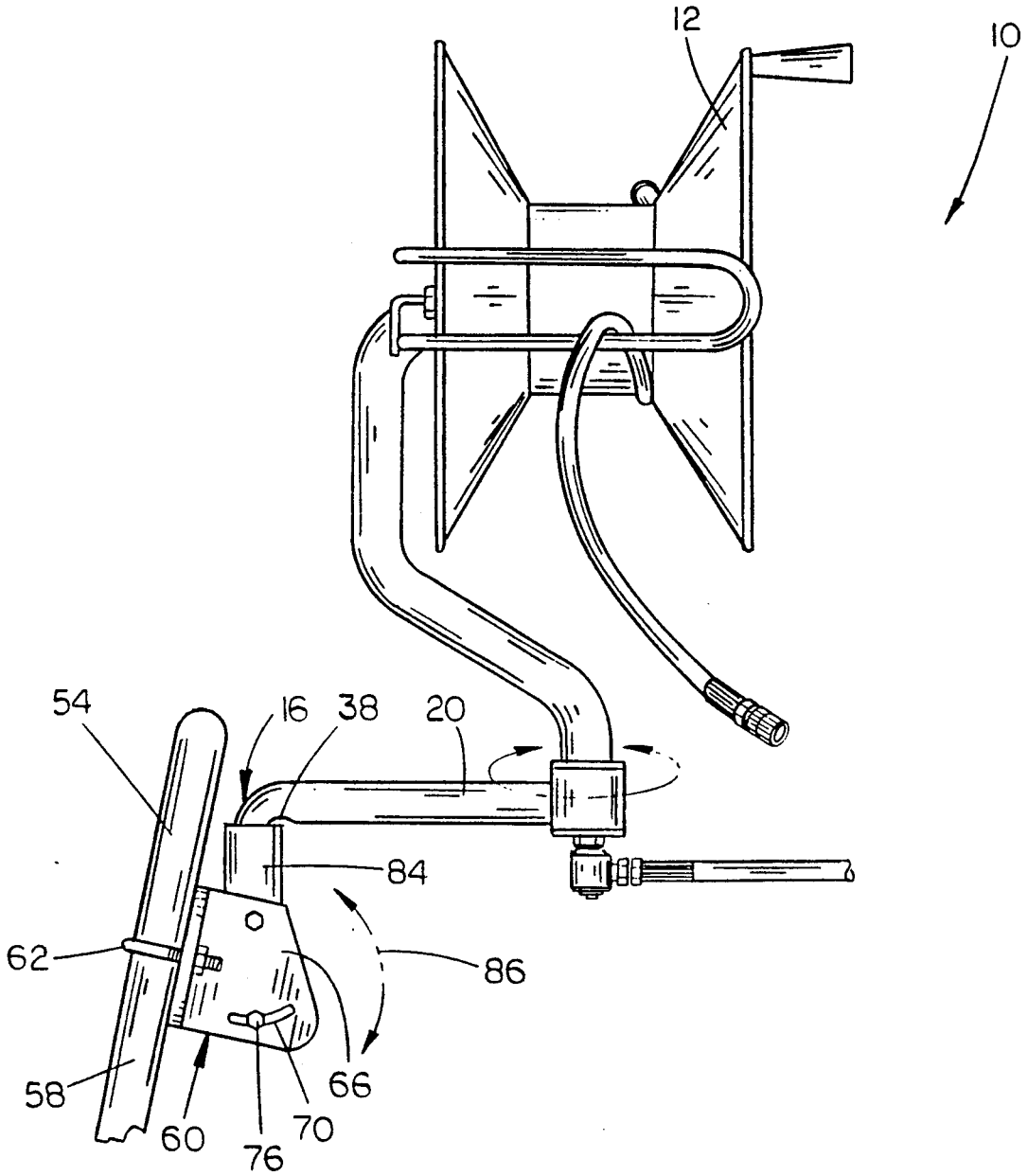
FIG. 4 is an elevational view of a hose reel mounted in a third embodiment of a support bracket.
Figure 5:
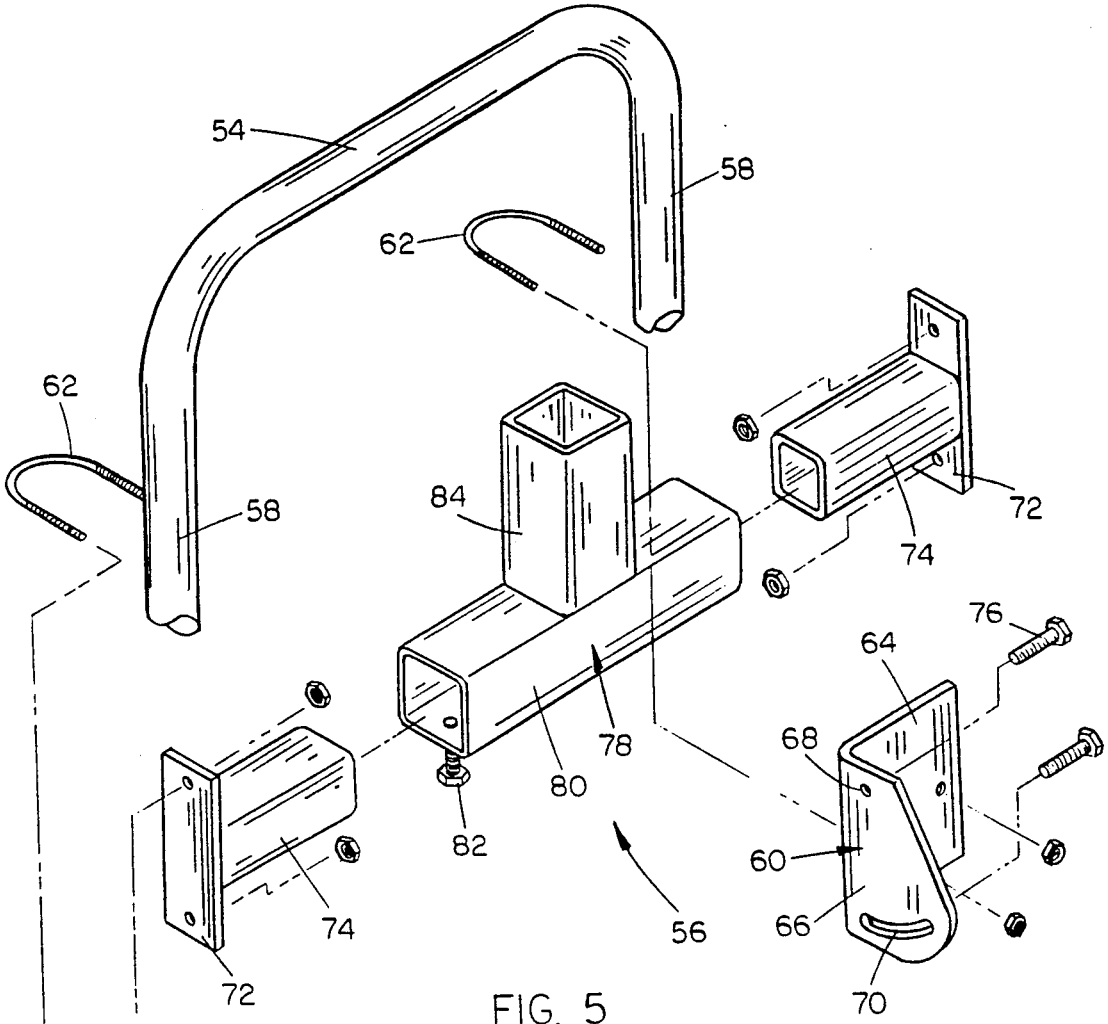
FIG. 5 is an exploded perspective view of the support bracket of FIG. 3.

Referring now to FIGS. 4 and 5, hose reel 10 may also be attached to the generally parallel legs of a handle 54 of a conventional high pressure washer cart. An adjustable bracket 56 is connected between the legs 58 of handle 54, and includes a pair of support members 60 connected to each leg 58 with a U-bolt 62. Support members 60 each include a base portion 64 through which U-bolt 62 is fastened, and a projecting portion 66, projecting generally perpendicular to base portion 64. In this fashion, projecting portions 66 of the two support members 60 will be parallel when fastened to legs 58.

Projecting portions 66 include an upper aperture 68 and a lower arcuate slot 70 to which the base plate 72 of a short length of tube 74 is attached via bolts 76. Short tubes 74 are coaxial and project towards one another and will receive a generally T-shaped hollow tubular member 78 (hereinafter "T-tube"). T-tube 78 has a horizontally extending elongated base tube 80 with dimensions to slide telescopically over tubes 74. A set screw 82 is journaled through base tube 80 and will engage one of short tubes 74 to maintain base tube 80 in the desired position on short tubes 74.

Upstanding receiver tube 84, mounted on base tube 80, may be adjusted so as to be vertical regardless of the angle of handle 54, by loosening and tightening bolts 76 within slots 70 in projecting portions 66 of support members 60. Arrow 86, in FIG. 4, indicates the relative pivotal movement possible by upstanding tube 84. In addition, base tube 80 can be removed and turned at 90° increments with respect to short tubes 74, to provide a wide variety of different angles at which upstanding tube 84 may be set.

Thus, the combination of the arcuate slot with the capability of base tube 80 at 90° increments, permits upstanding tube 84 to be adjustable through a full 360° in a vertical plane.

Referring again FIG. 6, bracket 40 may also be utilized to mount the hose reel 10 (not shown) to a vertical pole 44. A pair of U-bolts 88 are journaled around pole 44 and through sleeves 48. A washer and nut combination 90 is threaded on each U-bolt leg, to affix bracket 40 in position.

Whereas the invention has been shown and described in connection with the preferred embodiments thereof, it will be understood that many modifications, substitutions and additions may be made which are within the intended broad scope of the appended claims. There has therefore been shown and described an improved support bracket for hose reels which accomplishes at least all of the above stated objects.

I claim:

1. A support bracket for a hose reel of the type having a reel rotatably mounted on a support tube, comprising:

a support arm for supporting said reel, including a generally horizontal leg and a generally vertical leg depending from the horizontal leg;

said support tube connected to the horizontal leg of said support arm, to support the reel;

a generally vertically oriented receiver tube having upper and lower ends;

the lower end of said support arm vertical leg removably, slidably journaled with the receiver tube upper end to support said reel;

a first pair of vertically spaced apart sleeves, oriented parallel and horizontally and affixed to one side of said receiver tube; and a second pair of vertically spaced apart sleeves, oriented parallel and horizontally and affixed diametric to said first pair of sleeves and parallel thereto.

2. The hose reel of claim 1, wherein said receiver tube is rectangular in cross-section and wherein said vertical support leg is rectangular in cross-section.

3. The hose reel of claim 1, further comprising a support plate affixed flush to one side of said receiver tube, perpendicular to said first and second pairs of sleeves, to strengthen said receiver tube.

4. The support bracket of claim 1, further comprising means for preventing rotational movement of said support arm vertical leg about its vertical axis within said receiver tube.

5. A support bracket for a hose reel of the type having a reel rotatably mounted on a support tube, comprising:

a support arm for supporting said reel, including a generally horizontal leg and a generally vertical leg depending from the horizontal leg;

said support tube connected to the horizontal leg of said support arm, to support the reel;

a generally vertically oriented receiver tube having upper and lower ends;

the lower end of said support arm vertical leg removably, slidably journaled with the receiver tube upper end to support said reel;

said receiver tube being connected between a pair of spaced apart and parallel legs of a cart handle, and further comprising:

said receiver tube being mounted on an elongated horizontal tubular member and perpendicular thereto, said elongated horizontal tubular member having first and second ends;

a first connecting bracket selectively connecting one leg of the handle to the first end of said elongated horizontal member; and a second connecting bracket selectively connecting the other leg of the handle to said second end of the elongated horizontal tubular member.

6. The hose reel of claim 5, wherein said first and second connecting brackets are selectively adjustable to permit adjustment of the orientation of said receiver tube about the longitudinal axis of the elongated horizontal tubular member.

7. A support bracket for a hose reel of the type having a reel rotatably mounted on a support tube, comprising:

a support arm for supporting said reel, including a generally horizontal leg and a generally vertical leg depending from the horizontal leg;

said support tube connected to the horizontal leg of said support arm, to support the reel;

a generally vertically oriented receiver tube having upper and lower ends;

the lower end of said support arm vertical leg removably, slidably journaled with the receiver tube upper end to support said reel;

said receiver tube being mounted on an elongated axle and perpendicular thereto; wheels rotatably mounted on said axle;

at least one support leg projecting horizontally from said axle with a foot portion adapted for ground engagement; and a handle projecting from said receiver tube for moving said support bracket on said wheels.

8. A support bracket for a hose reel of the type having a reel rotatably mounted on a support tube, comprising:

a support arm for supporting said reel, including a generally horizontal leg and a generally vertical leg depending from the horizontal leg;

said support tube connected to the horizontal leg of said support arm, to support the reel;

a generally vertically oriented receiver tube having upper and lower ends;

the lower end of said support arm vertical leg removably, slidably journaled with the receiver tube upper end to support said reel;

said support tube including an upstanding tube portion extending downwardly from a horizontal tube portion, said reel rotatably mounted on the horizontal tube portion and said support arm connected to the upstanding tube portion.

* * * * *